US007347259B2

(12) United States Patent
Ravensbergen et al.

(10) Patent No.: US 7,347,259 B2
(45) Date of Patent: Mar. 25, 2008

(54) DOWNHOLE OILFIELD EROSION PROTECTION BY USING DIAMOND

(75) Inventors: John Edward Ravensbergen, De Winton (CA); Mitchell D. Lambert, Calgary (CA)

(73) Assignee: BJ Services Company, Houston, TX (US)

( * ) Notice: Subject to any disclaimer, the term of this patent is extended or adjusted under 35 U.S.C. 154(b) by 293 days.

(21) Appl. No.: 10/929,340

(22) Filed: Aug. 27, 2004

(65) Prior Publication Data

US 2005/0077042 A1 Apr. 14, 2005

Related U.S. Application Data

(60) Provisional application No. 60/499,090, filed on Aug. 29, 2003.

(51) Int. Cl.
*E21B 17/00* (2006.01)

(52) U.S. Cl. ..... 166/242.4; 166/311; 166/312; 166/222

(58) Field of Classification Search ..... 166/242.4, 166/312, 311, 56
See application file for complete search history.

(56) References Cited

U.S. PATENT DOCUMENTS

| | | | | |
|---|---|---|---|---|
| 3,200,585 A | | 8/1965 | Climent et al. | 60/35.6 |
| 4,135,861 A | | 1/1979 | Brown et al. | 417/183 |
| 4,280,662 A | | 7/1981 | Erickson et al. | 239/591 |
| 4,644,974 A | | 2/1987 | Zingg | 138/44 |
| 4,753,577 A | | 6/1988 | Black et al. | 417/172 |
| 5,033,545 A | * | 7/1991 | Sudol | 166/312 |
| 5,355,967 A | | 10/1994 | Mueller et al. | 175/65 |
| 5,638,904 A | | 6/1997 | Misselbrook et al. | 166/384 |
| 5,842,516 A | * | 12/1998 | Jones | 166/56 |
| 6,015,015 A | | 1/2000 | Luft et al. | 166/384 |
| 6,354,371 B1 | | 3/2002 | O'Blanc | 166/69 |
| 6,527,067 B1 | | 3/2003 | Ravensbergen et al. | 175/381 |
| 6,817,550 B2 | * | 11/2004 | Taylor et al. | 239/591 |

(Continued)

FOREIGN PATENT DOCUMENTS

| | | |
|---|---|---|
| GB | 1 543 371 | 1/1980 |

OTHER PUBLICATIONS

Sp3: Diamond Cutting Tools website—"Application of Diamond Cutting Tools to Abrasive Materials"—Aug. 23, 2003.

(Continued)

*Primary Examiner*—David Bagnell
*Assistant Examiner*—Brad Harcourt
(74) *Attorney, Agent, or Firm*—Howery LLP

(57) ABSTRACT

A device for use with components for a downhole tool—such as a throat, a nozzle, or a diffuser—used for cleaning a wellbore, are disclosed which decreases the erosion of the components. The device may be comprised of a hardened material, such as stack of pure diamond disks brazed to form an insert for a throat. The device may also be comprised of polycrystalline diamond (PCD) washers stacked together and mechanically secured within the component such as a throat. The device may also be comprised of diamond grown on a mandrel into a trumpet shape, which may then be brazed or epoxied into the component. As each of these materials is harder than materials previously utilized, erosion performance is enhanced. A method of improving erosion performance of components utilized to clean a wellbore is also disclosed.

25 Claims, 5 Drawing Sheets

U.S. PATENT DOCUMENTS

| | | | | |
|---|---|---|---|---|
| 6,832,654 | B2 | 12/2004 | Ravensbergen et al. | 166/308.1 |
| 7,243,727 | B2 | 7/2007 | Tudor et al. | 166/308.1 |
| 7,273,108 | B2 | 9/2007 | Misselbrook | 166/381 |

OTHER PUBLICATIONS

Combined International Search and Examination Report dated Dec. 22, 2004.
Examination Report dated Nov. 9, 2005.
Examination Report dated Apr. 10, 2006.
UK Examination Report dated Oct. 4, 2007.
(http://www.glossary.oilfield.slb.com/Display.cfm?Term=bottomhole%20assembly) (dated Oct. 26, 2007) noted on the Examination Report submitted Oct. 25, 2007.
Canadian Search Report dated Aug. 2, 2007.
Great Britain Examination Report dated Mar. 1, 2007.
Canadian Examination Report dated Sep. 15, 2006.

* cited by examiner

DOWNHOLE OILFIELD EROSION PROTECTION BY USING DIAMOND

CROSS REFERENCE TO RELATED APPLICATIONS

This application is a non-provisional application based on U.S. Provisional Patent Application Ser. No. 60/499,090, entitled "Downhole Oilfield Erosion Protection by Using Diamond" by John Ravensbergen and Mitchell Lambert, filed Aug. 29, 2003, incorporated by reference in its entirety herein.

BACKGROUND OF THE INVENTION

1. Field of the Invention

The present invention relates to the cleaning of wellbores in the field of oil and gas recovery. More particularly, this invention relates to a device adapted to improve the erosion performance of components utilized in the cleaning of solid particulate matter from a well.

2. Description of the Related Art

In the oil and gas industry, wellbores often become plugged with sand, filter cake, or other hard particulate solids, which need to be removed periodically to improve oil production. Prior art methods for cleaning the wellbore and the removal of these particulate solids include pumping a fluid from the surface to the area to be cleaned. To effectively clean the solids from the wellbore, the pumped fluids must return to surface, thereby establishing circulation. Therefore, the bottom of the hole circulating pressure must be high enough to support circulation but low enough to prevent leak off into the reservoir. In addition, the fluid must suspend and transport the solids. The fluid velocity and Theological properties must support solids transport.

It is known that the bottom hole pressure of a wellbore declines as the reservoir matures, thereby complicating the wellbore cleanout. For example, if the fluid being pumped into the wellbore exits the work string (e.g., coiled tubing) at an excessive pressure, the fluid may enter the formation instead of returning to the surface with the sand particulates.

To overcome this problem, it is known to utilize gasification (e.g., by the addition of nitrogen to the fluid) to decrease the hydrostatic pressure in the wellbore. Thus, the fluid may be pumped at reduced bottom hole pressures and circulation through the wellbore may be restored to transport the particulates to the surface. However, over time, the reservoir pressure may decline to a point whereby gasification fails to result in consistent circulation of fluid to effectively remove the particulates.

Reverse circulating is another method commonly used to increase the transport velocity of the fluid, especially when employing small diameter tubing in large wellbores.

Yet another prior art method of removing the particulate solids in the wellbore where the bottomhole circulating pressure is a concern employs a jet pump, as described in U.S. Pat. No. 5,033,545 to Sudol, issued Jul. 23, 1991, incorporated by reference herein in its entirety. The jet pump is attached to a coiled tubing inside coiled tubing string (CCT). The power fluid is pumped down the inner string and returns, both the power fluids as well as the reservoir fluids, are taken up the coiled tubing coiled tubing annulus. The jet pump is designed such that reservoir fluids enter the pump at the bottom hole pressure (BHP). The jet pump then increases the pressure of the fluid pumping the fluids up the work string with the solid particulates entrained in the fluids. Thus, circulation is facilitated as the circulation no longer depends on BHP alone.

FIG. 1 shows an exemplary prior art jet pump apparatus (BHA) and method for effectively removing particulates such as sand from within a wellbore. The jet pump is particularly well suited for use with coiled tubing. The following is a simplified summary of the operation of this apparatus and method. A jet pump 5 is shown within a wellbore. The jet pump 5 is attached to the bottom of CCT (not shown) via housing 6. In operation, fluid is pumped down the inner coiled tubing (from left to right in FIG. 1). The fluid enters the BHA and ported into the lower end of jet pump 5 as shown by the arrows. As the fluid passes through nozzle 1, the velocity of the fluid increases significantly, creating a jet stream. This increased velocity creates a low pressure that is felt at the entrance 7 to the jet pump 5. The low pressure draws fluid and solid particles into the jet pump. Subsequently wellbore fluids and solids contained therein are entrained into the jet stream. The high-velocity fluid with sand particulates then enters the entrance end of the throat 100. As the fluid with the sand particulates continues to travel upward through the throat 100, the diameter of the throat increases, the velocity of the fluid decreases, and the fluid pressure increases.

This method is commonly practiced with the use of coil-in-coil tubing, as described in U.S. Pat. No. 5,638,904 by Misselbrook et al., issued Jun. 17, 1997, incorporated by reference herein in its entirety.

It has been determined that in some applications, the high-velocity impact of the sand-ladened fluids with the entrance of the throat causes excessive erosion in the high impact area 2. Other methods to remove particulate solids which utilize a nozzle, a throat, or a diffuser for entraining the sand-water slurry environment also experience excessive erosion. This erosion is generally most prominent at the nozzle, throat, or diffuser, as these are the pinch points for the flow of fluid and are associated with higher velocity streams.

Erosion of the downhole tools may be exasperated when cleaning particulates from deeper wells. Deeper wells produce additional challenges for the above-referenced procedure, as the deeper wells have increased hydrostatic pressure and increased friction pressure. Thus, the coiled tubing operation must incorporate higher pump output pressure and higher jet velocities in the nozzle and throat. For example, it is not uncommon for 8600 foot well to have 1000 p.s.i. bottom hole pressure, causing the flow velocity through the throat to be between 200 and 600 feet per second. These higher particle laden jet velocities increase the erosion rate in the throat.

Thus, there is a need for a device for improving erosion performance of devices used in the cleaning of a wellbore, such as nozzles, throats, or diffusers utilized downhole. The device should resist erosion associated with the high velocity jets of sand/water slurries generated when removing particulate solids, such as sand, from the wellbore during well intervention or workover.

It is also known to decrease the erosion of the components of downhole tools by manufacturing the components of various materials, such as ceramics like TTZ stabilized zirconia, or 6% submicron tungsten carbide. However, these prior art methods fail to provide the desired level of erosion performance and may not be economically feasible with deeper wells (and the concomitant increase jetting velocities), as excessive erosion may still result. Thus, there is a need for improving the erosion performance (i.e. decreasing the erosion) of components used in the cleaning of a wellbore when the components are exposed to high velocity sand/fluid slurries.

SUMMARY OF THE INVENTION

The invention relates to a device and method for improving the erosion performance (i.e. decreasing the erosion) of components of downhole tools—e.g. nozzles, throats, and diffusers—used when removing particulate solids from the wellbore. The invention may include an insert, e.g. for a throat of a pump assembly to decrease erosion along the entrance, barrel, and/or diffuser of the throat.

The insert may be comprised of a hardened material, such as a plurality of diamond disks, formed from platelets, which are brazed into one integral insert. The diamond disks may also be stacked next to each other and mechanically secured within the throat.

In some embodiments, the device may be comprised of one or more washers, each of which may be formed from polycrystalline diamond (PCD)—diamond crystals in an encompassing cobalt matrix. These washers may be sequentially stacked within the component, such as a throat, and mechanically secured therein. Such PCD washers may be machined from commercially-available blanks of various sizes.

Also disclosed is a device comprising an insert for a downhole tool, the insert being grown from diamond crystals. The diamond may be grown on a mandrel. Once the mandrel is machined away, the resulting insert is trumpet shaped, and may have a flare. The trumpet may be affixed within the downhole tool via epoxy or brazing, for example. Further, the trumpet may be comprised of a plurality of pieces, or may comprise an integral unit.

Once mounted within the downhole component, the inner surface of the devices described herein may be polished along with the remainder of the inner surface of the downhole tool such as a throat to increase the surface finish, which further enhances erosion performance.

A method of using the devices mentioned above is also disclosed, as is a method of improving the erosion performance of downhole tools utilized in the removal of particulate solids from the wellbore.

Figure 1:
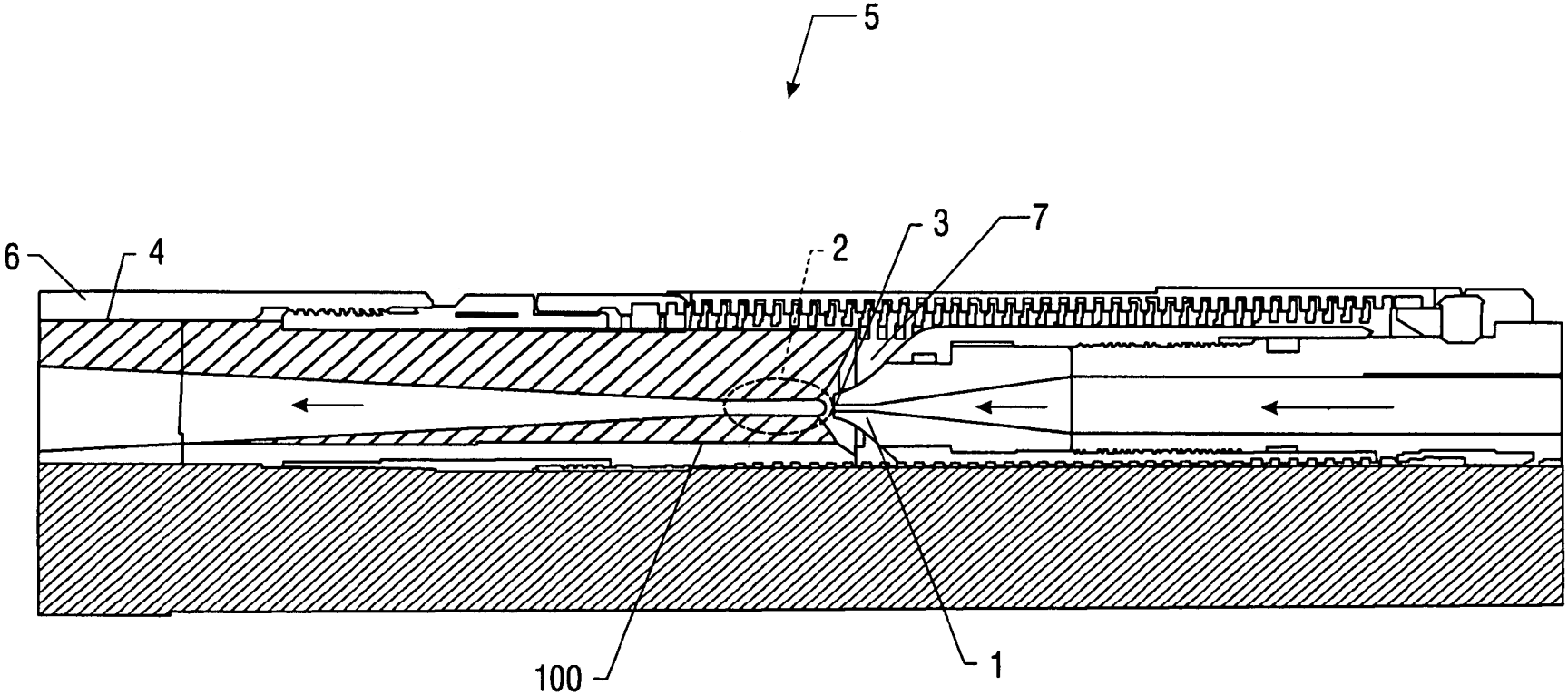
FIG. 1 (Prior Art)
FIG. 1 shows a cutaway view of a jet pump known in the prior art.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Figure 2A:
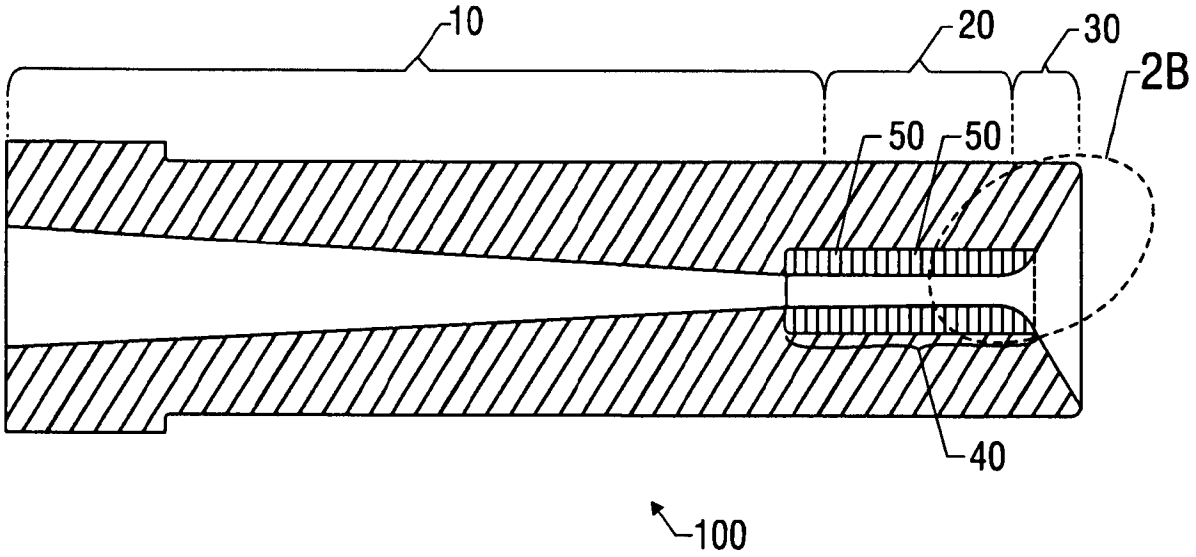
FIGS. 2A and 2B show an embodiment of the insert of the present invention comprising disks.
Figure 2B:
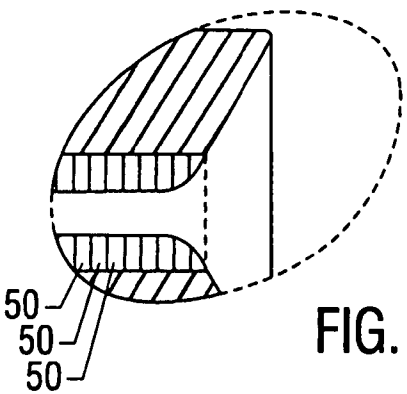

Embodiments of the invention will now be described with reference to the accompanying figures. Dimensions described or shown are intended for example only, as the invention disclosed herein is not limited thereto. The invention is particularly well suited for use in a throat for a downhole jet pump. Referring to FIGS. 2A and 2B, a throat 100 is shown comprised of three sections: the diffuser section 10, the barrel section 20, and the entrance section 30. The diffuser section 10 may comprise a 6 degree taper therethrough, as shown. The throat 100 may be comprised of any hardened material suitable for downhole use, such as 6% cobalt tungsten carbide. Flow of fluid during the cleanout procedure is from right to left (i.e. the surface is on the left, and the obstruction being removed from the wellbore is on the right).

In this embodiment, the present invention includes an insert 40, comprised of a plurality of disks 50. In this embodiment, the disks 50 comprise pure diamond, which are brazed into one insert 40. Each disk may be laser machined from commercially-available pure diamond sheets. An example of the final dimensions of the disks are: 0.040" thick (1 mm plus 0.0005" braze), having a 7 mm (0.28") outer diameter and a 2.59 mm (0.102") inner diameter. Alternatively, other sheet thickness could be used, for example diamond disks 1.2 mm (0.047") or 1 mm (0.039") thick may be utilized, separately or in combination to achieve a desired insert length.

These diamond disks 50 are comprised of relatively pure diamond crystal (grown in platelet form), from suppliers of pure diamond, such as SP3 Inc., of Mountain View, Calif. The stack of disks may be brazed into a single insert 40 utilizing a high temperature process that uses, for example, a braze such as Cusil ABA, which is comprised of copper, silver and 2% titanium. The insert is then attached to the tungsten carbide throat using a low temperature process and a braze such as Incusil ABA (comprised of indium, copper, silver and titanium). As such, the resulting insert 40 has a higher surface hardness than inserts of the prior art, thus improving the erosion-resistance of the insert 40. Also, the absence of binders avoids chemical interaction with other materials. Further, the thermal conductivity of diamond is higher than that for other prior art materials used in the manufacture of the 100. In operations where the throat erosion is being affected by an increase of the surface temperature, inserts 40 made of substantially pure diamond disks 50 may be preferable to inserts comprised of other materials.

The insert 40 is shown located primarily within the barrel section 20 of the throat 100. In the illustrated embodiment, the insert 40 comprises a stack of twenty two disks 50. Fifteen of the disks 50 are shown within the barrel section 20 of the throat 100. In this embodiment, the insert 40 also protrudes into the diffuser section 10 of the throat 100. As shown in this embodiment, four disks 50 of the insert 40 protrude into the diffuser section 10 of the throat 100. These four disks 50 may comprise an inner diameter having a 6 degree taper to match the internal diameter of the diffuser section 10, or these four disks 50 may have a uniform inner diameter matching the inner diameter of the insert 40. Further, the outermost diamond disk 50 abutting the diffuser section 10 may comprise a chamfered outer diameter.

The insert 40 may also protrude into the entrance section 30 of the throat 100. As shown, three disks 50 extend into the entrance section 30. As shown in FIG. 2B, these three disks 50 may conform to the geometry of the entrance section 30 of the throat 100. In this example, the three disks 50 have a 30 degree taper to match the taper of entrance 30.

The overall length of the insert may be varied according to the size of the throat 100, e.g. In this example, the overall length of the throat is 3.78" (96 mm), while the overall length of the insert 40 is 1.042" (26.5 mm).

It should be noted the number of disks 50 utilized to comprise insert 40 of this embodiment may vary as well as the dimension of the disks 50. For instance, an insert 40 of this embodiment may also comprise 15 disks 1.2 mm thick and 4 disks 1 mm thick. Thus, the invention is not limited by a given number or dimension of disks 50.

In operation, (as described above with respect to FIG. 1), the high-velocity fluid with sand particulates enters entrance end 30 of the throat 100. The sand particulates then contact the insert 40, instead of directly contacting throat 100. As the diamond surface of the insert 40 is significantly harder than material of the throat, the erosion performance of the throat 100 is improved. The throat 100 having the insert 40 of the present invention is thus an improvement over prior art throats having no erosion-resistant insert.

Figure 3A:
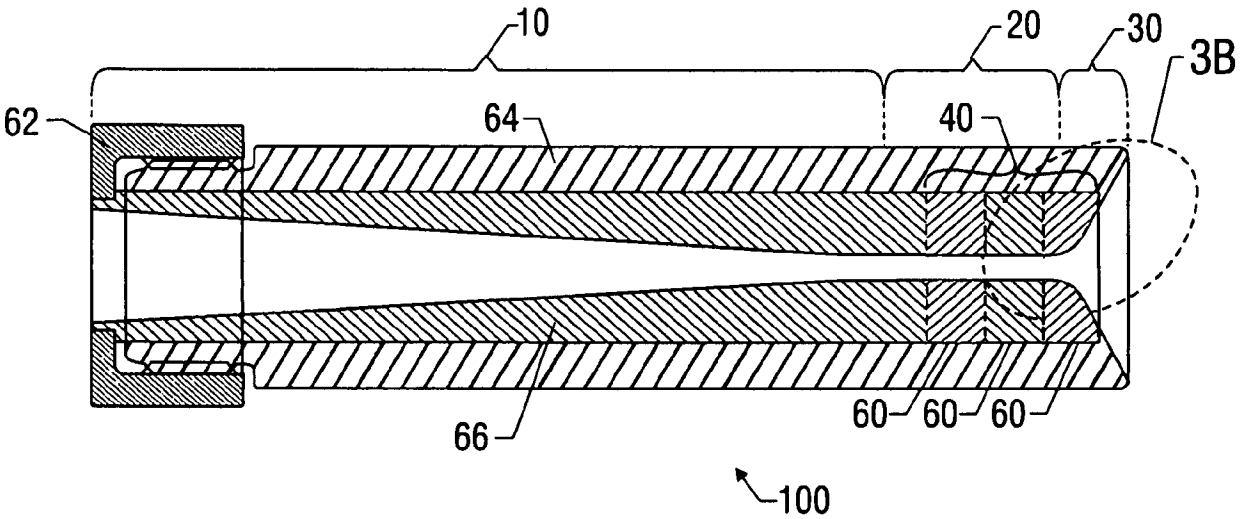
FIGS. 3A and 3B show an embodiment of the present invention comprising PCD washers.
Figure 3B:
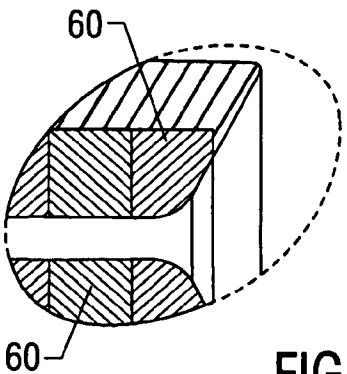

FIGS. 3A and 3B show another embodiment of the present invention in which the insert 40 comprises a plurality of washers 60. In the embodiment shown in FIG. 3A, three washers 60 are shown, although the number of washers 60 can vary depending upon the throat 100 being utilized and the desired performance characteristics of the insert 40. Washers 60 are preferably comprised of erosion-resistant crystalline diamond (PCD). Commercial suppliers of PCD material include Thomas Wire Die, Ltd. of Ontario, Canada. These PCD washers may be formed from commercially-available blanks, which are available in various shapes and sizes. The PCD washers 60 may be comprised of crystals having, for example, 5, 25, or 50 micron diameter diamond crystals sintered into the matrix of cobalt. It has been found that the PCD blanks may be machined into washers (60) more easily than pure diamond, by utilizing processes known to one of ordinary skill in the art having the benefit of this disclosure, such as by EDM (electron discharge machining). Additionally, these PCD washers may be polished to further improve erosion resistance.

In this embodiment, it will be noted that each of the washers 60 may directly abut each other to form insert 40, i.e., no brazing material is present between the surfaces of the washers 60. To keep the PCD washers 60 in place within the throat 100, the washers 60 abut inner diffuser section 66. In this embodiment, inner diffuser section 66 is comprised of tungsten carbide. The washers 60 and the inner diffuser section 66 are located within sleeve 64, which may be comprised of stainless steel. Nut 62 is threaded on the outer body 64 of the throat 100 to secure the washers 60 within the throat 100, as shown in FIG. 3, thus, providing means for securing the inner diffuser section 66 and washers 60 within the throat.

It should be noted that once assembled, the entire inner surface of the throat, i.e. the inner diameters of the entrance section 10, the insert 40, and the diffuser section 10 may be polished to remove any burrs or sharp edges, from the entrance section 10 through the length of the entire throat 100. This also improves the erosion performance of the insert 40, as erosion is decreased with improved surface finish.

Returning to the embodiment of FIGS. 3A and 3B, washers 60 may protrude within entrance section 30 of throat 100, as shown in detail in FIG. 3B. The PCD washer 60 within the entrance section 30 may have an inner diameter to conform to that of the entrance section 30, shown at a 30 degree taper in FIG. 3B. As shown, the insert 40 comprising of the PDC washers 60 does not enter the diffuser section 10 of the throat 100. However, as with the embodiment of FIGS. 2A and 2B, a portion of the insert 40 may protrude within the diffuser section 10 of throat 100, and have a tapered surface to conform to that of the diffuser section 10.

Experimental results have been obtained for this embodiment of the present invention. Sand was removed from a simulated well. Simulated well conditions were 8600 feet deep, 1000 p.s.i. bottom hole pressure (BHP), and diffuser/throat flow velocity of 600 feet per second. The erosion of the entrance and barrel section of the throat 100 having the insert 40 of this embodiment of the present invention with PCD washers 60 was compared to that of the prior art throat, which was made of 6% submicron cobalt tungsten carbide, after each throat had been exposed to similar conditions. A 12-fold improvement in erosion performance was noted with the use of the insert 40 having PCD washers 60.

It should be noted that in another embodiment not shown, the insert 40 of FIG. 2 (i.e. the plurality of pure diamond disks 50) may be assembled in a manner similar to the diamond washers of FIGS. 3A and 3B. That is, the diamond disks 50 may be stacked directly next to each other without the use of brazing material. In this embodiment, the diamond disks 50 are secured within the throat 100 by inner diffuser 66 being within a sleeve 64, secured by a nut 62, as described with respect to FIG. 3A. This is advantageous because the brazing material may be relatively soft, thus eroding more quickly than the diamond, thus exposing the edges of the disks, which may decrease erosion performance.

Figure 4A:
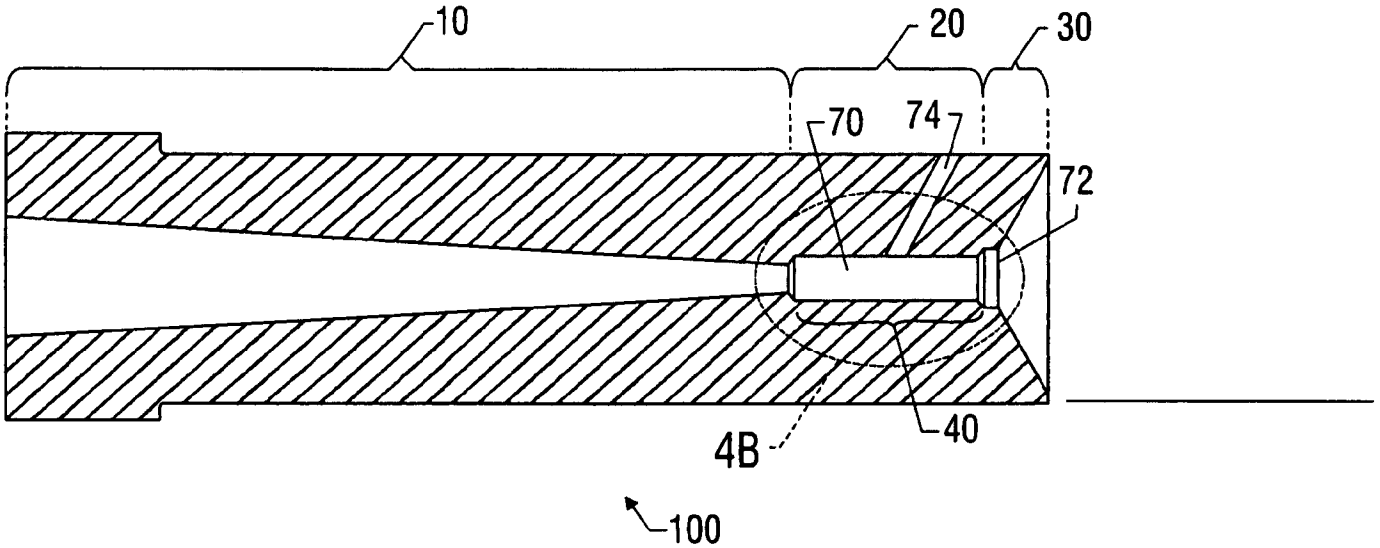
FIGS. 4A and 4B show an embodiment of the present invention comprising a diamond trumpet brazed into the throat.
Figure 4B:
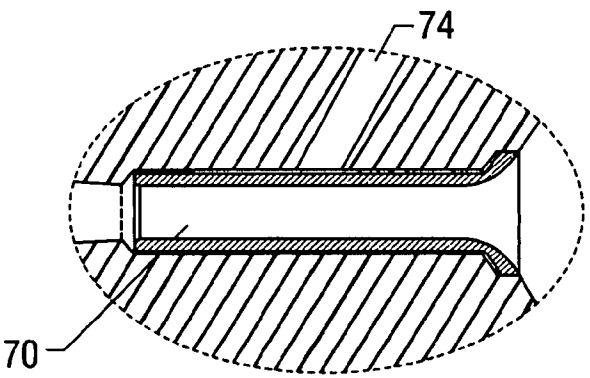

Now referring to FIGS. 4A and 4B, another embodiment of the present invention is shown. In this embodiment, insert 40 is comprised of an integral trumpet or tubule 70 having a flare 72. The trumpet 70 is comprised of a single piece of diamond that may be grown on a cone or mandrel to the desired size and shape using a plasma flame. After the diamond is grown on the mandrel, the mandrel may be machined out to leave only the trumpet 70. The trumpet 70 may then be machined as necessary, to form flare 72, for example. The resulting long, columnar crystals are oriented perpendicular to the flow direction, the crystals oriented perpendicular to the flow direction of the sand-laden fluid have superior erosion resistance as compare to crystals randomly oriented or oriented parallel to the flow direction.

In the embodiment shown, the flare 72 of the trumpet 70 of the insert 40 extends into the entrance section 30 of the throat 100. The remainder of the trumpet 70 may reside in the barrel section 20 of the throat 100. Although not shown as such, the other end the trumpet 70 in another embodiment may protrude within the diffuser section 10 of throat 100.

In this embodiment, the trumpet 70 is brazed within the throat. To facilitate this process, the throat 100 further comprises a braze feed path or hole 74 utilized to supply brazing material.

Figure 5A:
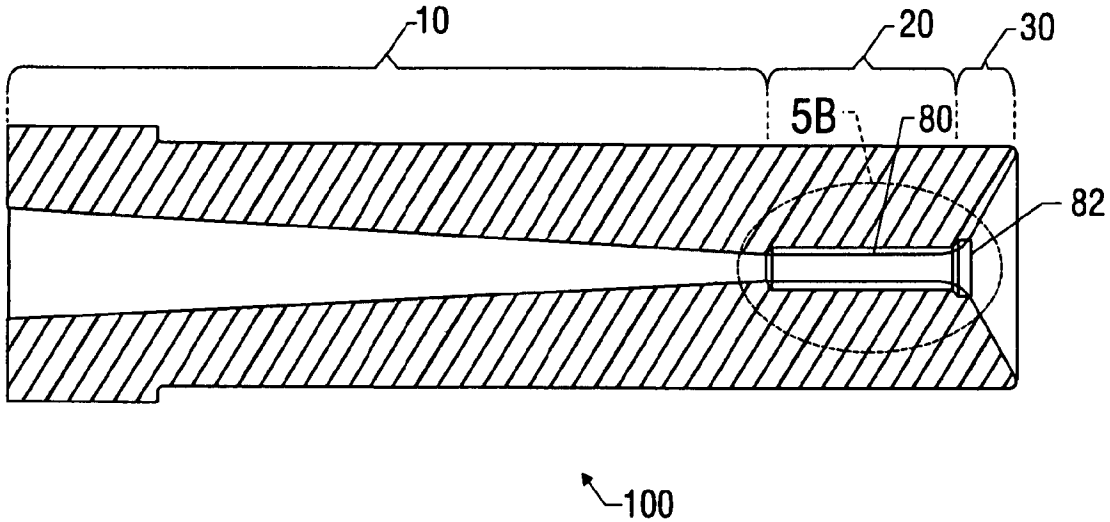
FIGS. 5A and 5B show an embodiment of the present invention comprising a diamond trumpet epoxied into the throat.
Figure 5B:
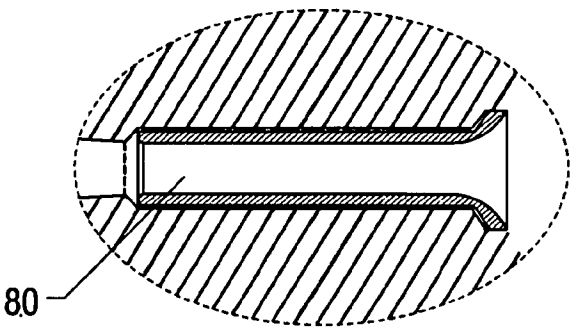

Referring to FIG. 5A and FIG. 5B, another embodiment of the insert 40 of the present invention is shown as a trumpet 80 having a flare 82. The configuration of this embodiment is identical to that shown in FIG. 4, with the exception within the throat diamond trumpet 80 is epoxied within the throat 100, instead of being brazed within the throat 100 as shown in FIG. 4. Thus, the throat 100 does not require a braze feed hole.

Additionally, the trumpet 70 may be comprised of two sections in some embodiments. The trumpet may have a mouth having a larger inner diameter than the barrel section of the trumpet, the mouth being on the opposite end of the trumpet than the flare, and extending into the diffuser section 10.

Although various embodiments have been shown and described, the invention is not so limited and will be understood to include all such modifications and variations as would be apparent to one skilled in the art. Specifically, although the disclosure is described by illustrating inserts for use with a throat, it should be realized that the invention is not so limited, and that the erosion-decreasing devices and methods disclosed herein may be equally employed on diffusers, nozzles, and the like exposed to high-velocity flow of fluid/particulates downhole.

What is claimed is:

1. A throat for a downhole tool, comprising:

an entrance section having an opening tapered at a first angle;

a barrel section adjacent the entrance section;

a diffuser section, adjacent the barrel section, having a taper at a second angle, the entrance section, the barrel section, and the diffuser section having a central opening therethrough; and an insert within the throat having an inner diameter, the insert having a plurality of disks adjacent one another, each disk having an inner diameter defining the insert opening, the plurality of disks made of substantially pure diamond, brazed together to form the insert, the insert made of a hardened material to protect the throat from erosion as a fluid enters the tapered opening of the entrance section, passes through the insert and the barrel section to the diffuser section, and exiting the tapered diffuser section, wherein the insert is within the throat such that a first set of disks are within the barrel section, a second set of disks are within the diffuser section, and a third set of disks are within the entrance section.

2. The throat of claim 1 wherein the second set of disks comprises four disks within the diffuser section having an inner diameter defining a taper along a length of the insert.

3. The throat of claim 2 wherein the taper is about six degrees.

4. The throat of claim 2, wherein an outermost disk of the four disks within the diffuser section has an outer diameter comprising a chamfer.

5. The throat of claim 1 wherein the third set of disks comprise the three disks within the entrance section having an inner diameter defining a taper along a length of the insert.

6. The throat of claim 5 wherein the taper of the three disks within the entrance section is about 30 degrees.

7. A throat for a downhole tool, comprising:

an entrance section having an opening tapered at a first angle;

a barrel section adjacent the entrance section;

a diffuser section, adjacent the barrel section, having a taper at a second angle, the entrance section, the barrel section, and the diffuser section having a central opening therethrough;

an insert within the throat having an inner diameter, the insert having a plurality of disks adjacent one another, each disk having an inner diameter defining the insert opening, the insert made of a hardened material to protect the throat from erosion as a fluid enters the tapered opening of the entrance section, passes through the insert and the barrel section to the diffuser section, and exiting the tapered diffuser section;

a sleeve;

an inner diffuser section adjacent one of the plurality of disks; and means for securing the inner diffuser section and the plurality of disks within the throat.

8. The throat of claim 1 or 7 wherein the first set of disks comprises fifteen disks.

9. A throat for a downhole tool, comprising:

an entrance section having an opening tapered at a first angle;

a barrel section adjacent the entrance section;

a diffuser section, adjacent the barrel section, having a taper at a second angle, the entrance section, the barrel section, and the diffuser section having a central opening therethrough;

an insert within the throat having an inner diameter, the insert having a plurality of washers, each having an inner diameter, the insert made of a hardened material to protect the throat from erosion as a fluid enters the tapered opening of the entrance section, passes through the insert and the barrel section to the diffuser section, and exiting the tapered diffuser section;

a sleeve;

an inner diffuser section adjacent one of the plurality of washers; and means for securing the inner diffuser section and the plurality of washers within the throat.

10. The throat of claim 9 in which the plurality of washers are made of polycrystalline diamond, each directly abutting one another to form the insert.

11. The throat of claim 10 in which at least one of the washers is within the entrance section, wherein the inner diameter of the at least one washer within the entrance section comprises a taper.

12. The throat of claim 11, in which the taper is about 30 degrees along the length of the insert.

13. The throat of claim 12, in which at least one of the plurality of washers is within the diffuser section having a tapered inner diameter forming substantially a six degree angle along a length of the insert.

14. The throat of claim 10 in which the central opening through the throat comprises a polished surface.

15. The throat of claim 1, in which the means for securing comprises a nut on adapted to threadedly engage an outer body of the sleeve.

16. A throat for a downhole tool, comprising:

an entrance section having an opening tapered at a first angle;

a barrel section adjacent the entrance section;

a diffuser section, adjacent the barrel section, having a taper at a second angle, the entrance section, the barrel section, and the diffuser section having a central opening therethrough;

an insert within the throat having an inner diameter, the insert comprising an integral trumpet having a flare, the trumpet being comprised of diamond, the insert made of a hardened material to protect the throat from erosion as a fluid enters the tapered opening of the entrance section, passes through the insert and the barrel section to the diffuser section, and exiting the tapered diffuser section; and a braze feed path extending radially outwardly through the throat from the trumpet.

17. The throat of claim 16, wherein the flare of the trumpet is within the entrance section of the throat and the remainder of the trumpet is within the barrel section.

18. The throat of claim 16 wherein the trumpet further comprises a mouth, opposite the flare and within the diffuser section, having an inner diameter greater than a diameter of a barrel section of the trumpet.

19. The throat of claim 16, wherein the trumpet is brazed within the throat.

20. A throat for a downhole tool, comprising:

an entrance section having an opening tapered at a first angle;

a barrel section adjacent the entrance section;

a diffuser section, adjacent the barrel section, having a taper at a second angle, the entrance section, the barrel section, and the diffuser section having a central opening therethrough;

an inset within the throat having an inner diameter, the insert comprising an integral trumpet having a flare, the trumpet being comprised of diamond, the insert made of a hardened material to protect the throat from erosion as a fluid enters the tapered opening of the entrance section, passes through the insert and the barrel section to the diffuser section, and exiting the tapered diffuser section, wherein the trumpet is made of diamond grown on a mandrel, the inner diameter being machined to form the trumpet.

21. The throat of claim 8 further comprises a braze feed path extending radially outwardly through the throat from the trumpet.

22. The throat of claim 16 or 20, wherein the trumpet is epoxied within the throat.

23. A downhole tool, comprising:

a bottom hole assembly having a central opening therethrough; and an insert having an inner diameter, within the bottom hole assembly, made of a hardened material to protect the bottom hole assembly from erosion as a fluid passes through the central opening and the insert, in which the insert comprises a plurality of disks made of substantially pure diamond, adjacent one another and brazed together to form the insert, each disk having an inner diameter, wherein the insert is within the throat such that a first set of disks are within the barrel section, a second set of disks are within the diffuser section, and a third set of disks are within the entrance section.

24. A downhole tool, comprising:

a bottom bole assembly having a central opening therethrough;

an insert having an inner diameter, within the bottom hole assembly, made of a hardened material to protect the bottom hole assembly from erosion as a fluid passes through the central opening and the insert, in which the insert further comprises a plurality of washers made of polycrystalline diamond directly abutting one another to form the insert, a sleeve;

an inner diffuser section adjacent on of the plurality of washers; and means for securing the inner diffuser section and the plurality of washers within the throat.

25. The downhole tool of claim 23 or 24, in which the bottom hole assembly is selected from the group consisting of a nozzle, a throat, and a diffuser.

* * * * *

UNITED STATES PATENT AND TRADEMARK OFFICE

CERTIFICATE OF CORRECTION

PATENT NO. : 7,347,259 B2
APPLICATION NO. : 10/929340
DATED : March 25, 2008
INVENTOR(S) : John Ravensbergen et al.

It is certified that error appears in the above-identified patent and that said Letters Patent is hereby corrected as shown below:

In column 9, line 32, replace “inset” with --insert--.

Signed and Sealed this

Seventeenth Day of June, 2008

JON W. DUDAS
*Director of the United States Patent and Trademark Office*